United States Patent [19]

Daunheimer et al.

[11] Patent Number: 4,741,783

[45] Date of Patent: May 3, 1988

[54] APPARATUS AND METHOD FOR ROTARY BUFFING

[75] Inventors: Lyn R. Daunheimer, Batavia; Mark A. Ruggie, Park Ridge, both of Ill.

[73] Assignee: Masonite Corporation, Chicago, Ill.

[21] Appl. No.: 948,060

[22] Filed: Dec. 31, 1986

[51] Int. Cl.[4] ..... B08B 1/02

[52] U.S. Cl. ..... 134/15; 15/72; 15/102; 15/106; 15/21 A; 15/21 D; 15/21 E; 51/96; 134/25.4

[58] Field of Search ..... 134/15, 25.1, 25.4; 15/106, 107, 21 D, 21 E, 22 A, 72, 102; 51/96

[56] References Cited

U.S. PATENT DOCUMENTS

| | | | |
|---|---|---|---|
| 2,329,555 | 9/1943 | Polk, Sr. | 146/3 |
| 3,441,968 | 5/1969 | Kramen | 15/97 |
| 3,581,333 | 6/1969 | Lieffring | 15/4 |
| 3,849,826 | 11/1974 | Takeuchi | 15/230.14 |
| 4,353,324 | 10/1982 | Schnittker | 15/21 E |
| 4,382,308 | 5/1983 | Curcio | 15/21 D |
| 4,476,601 | 10/1984 | Oka | 15/21 D |
| 4,570,278 | 2/1986 | Bloome et al. | 15/97 R |

*Primary Examiner*—Asok Pal

*Attorney, Agent, or Firm*—A. Lewis Worthem, Jr.; Robert H. Robinson; Robert M. Didrick

[57] ABSTRACT

Apparatus and method for rotary buffing or wiping of workpieces having uneven surfaces in which the workpiece generally linearly advances relative to one or more buffing rolls which are spinning about spin axes disposed in a plane generally parallel to the workpiece surface and simultaneously rotating about an axis generally perpendicuar to the workpiece surface. In a preferred embodiment, the buffing rolls are supported in a rotating carriage with their spin axes in coparallel relationship.

4 Claims, 2 Drawing Sheets

APPARATUS AND METHOD FOR ROTARY BUFFING

BACKGROUND OF THE INVENTION

1. Field of the Invention

This invention relates to the art of buffing, and more particularly to a method and apparatus for mechanized, automated, and uniform buffing or wiping of workpiece surfaces. The invention is especially suited for glaze stain buffing of large workpieces having rough, uneven, or recessed and elevated surfaces such as molded paneling or furniture components.

2. The Prior Art

It is known in the prior art to buff a workpiece surface by contacting the surface with a rotating buffing roll. For their wiping elements, such buffing rolls may have brush bristles, mop-like strings, or cloths. Buffing of the workpiece surface may be needed to achieve a desired surface smoothness or luster, or may be a step in a coating process wherein a glaze stain is applied to the surface, the surface wiped to distribute and penetrate the stain uniformly over the surface and the excess stain subsequently wiped away.

In large scale manufacturing operations, it is desirable to automate a buffing process as much as possible. For small, smooth, flat-surfaced workpieces, simply transporting the workpiece while it is in contact with a fixed-axis, rotating roller may be sufficient. However, when the workpiece is large and the surface irregular, such a simple approach may be inadequate to produce an evenly wiped finish and attain effective buffing contact with all areas of the surface.

One approach to mechanized workpiece buffing is exemplified in U.S. Pat. No. 3,441,968. That patent discloses a buffing machine having eight radially oriented buffing rolls mounted on a rotating turret. Relatively small workpieces, such as automobile wheel discs are individually tangentially conveyed into registration beneath a buffing roll. The rolls and workpieces move together in a circular path over approximately 180 degrees, during which time the workpieces are being spun to improve the finish quality. The workpieces are then tangentially conveyed away from the turret of buffing rolls.

The apparatus of U.S. Pat. No. 3,441,968 is subject to some significant disadvantages and limitations. It requires complex drive mechanisms and gearing to produce the combined orbital revolution and radial rotation of the buffing rolls. Additional mechanism is required to register the workpieces with the buffing rolls and to spin the workpieces beneath the rolls. If the workpieces are large, as with wall panels, it becomes impractical, or even hazardous, to spin the workpieces beneath the moving buffing rolls while maintaining registration. The workpieces exit the machine in the direction opposite the direction of entry, precluding use of the machine in a unidirectional, continuous manufacturing line.

What has been needed is a method and apparatus for workpiece buffing or wiping which is mechanically simple, which is capable of uniformly finishing irregular surfaces, and which is suitable for use in a linear, unidirectional manufacturing line.

SUMMARY OF THE INVENTION

The present invention satisfies the aforementioned needs by providing a method and apparatus for rotary wiping in which the workpiece generally linearly advances relative to one or more buffing rolls which are spinning about cylinder or spin axes disposed in a plane generally parallel to the workpiece surface and simultaneously rotating about an axis generally perpendicular to the workpiece surface.

According to a preferred embodiment of the invention, an endless conveyor belt is provided for linearly advancing a workpiece with the surface to be buffed generally horizontal and facing upwardly. Supported above the path of the workpiece is a carriage mounted to rotate about a generally vertical axis. Carried on the carriage are a plurality of buffing rolls having their spin axes parallel to each other and lying in a plane above and parallel to the workpiece surface. Suitable driving mechanisms are provided to rotate the carriage, and thereby the buffing rolls, about the vertical axis and to spin the buffing rolls about their spin axes.

While the carriage is rotating and the rolls are spinning, the workpiece is linearly advanced beneath the rolls with the surface of the workpiece in buffing contact with the rolls. The rolls are thus continually and infinitely reoriented with respect to the workpiece. Buffing action is therefore applied in all directions uniformly over the entire surface of the workpiece. The continual reorientation of the workpiece and buffing rolls with respect to each other allow the buffing elements to contact all areas of the workpiece surface.

In its preferred embodiment, the invention is disclosed being used to buff the surface of a hardboard panel molded in the shape of a doorskin. The doorskin surface has areas of significant recess which simulate the appearance and form of architectural millwork, and slightly depressed and elevated areas which simulate the appearance and texture of wood grain. In the process of manufacturing such a doorskin, it is desirable to apply a glaze stain coating to the panel surface, then to wipe the coating into the surface and remove the excess. The coating thereby stains the panel surface and highlights the simulated wood grain. The present invention is of particular effectiveness in buffing workpieces having such surface irregularities in a manufacturing line.

In the embodiment disclosed, the carriage is adapted for carrying buffing rolls along three coparallel spin axes. The first spin axis intersects the carriage vertical axis. The second and third spin axes are disposed on either side of the first spin axis. The spin of the buffing rolls is produced by a motor carried on the carriage.

It should be understood that the terms "buff" and "buffing" as used herein are intended to include wiping operations in general, including, for example, polishing and cleaning. The use herein of terms such as "spin" and "rotate" are intended to include angular motion generally as appropriate to the context of the invention, including, for example, orbital motion and revolution.

DESCRIPTION OF THE PREFERRED EMBODIMENT

Figure 1:
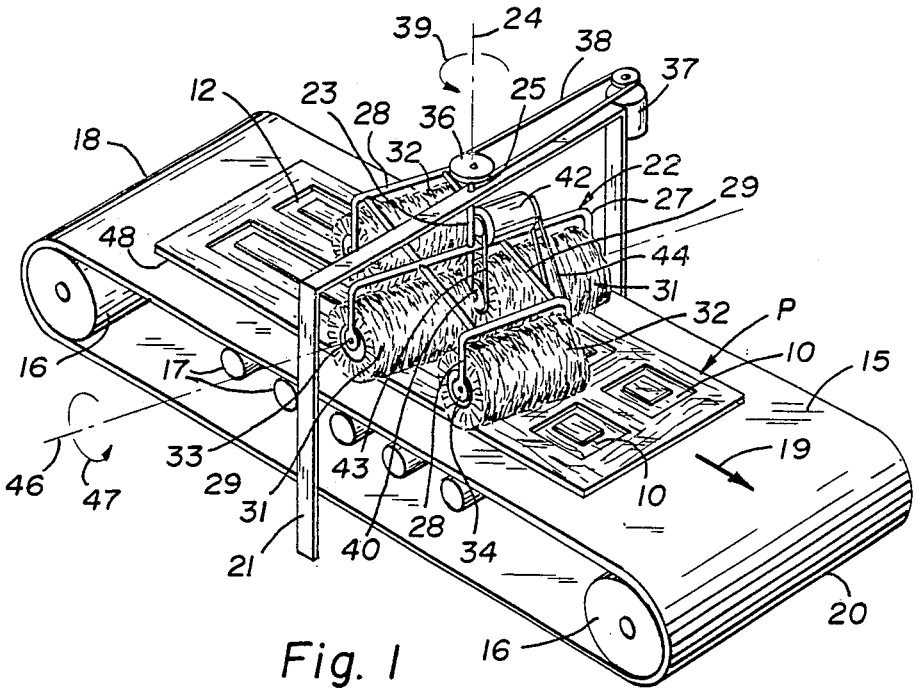
FIG. 1 is a perspective view of apparatus according to the invention being used to buff a surface of a molded panel.
Figure 2:
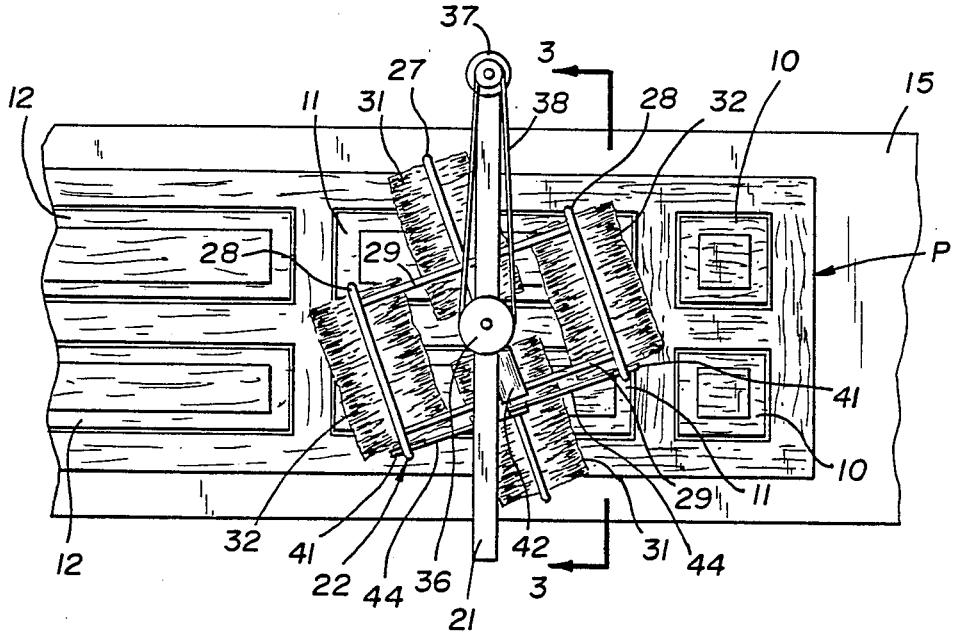
FIG. 2 is a fragmentary top view of the apparatus of FIG. 1, but with the carriage in a different position.
Figure 3:
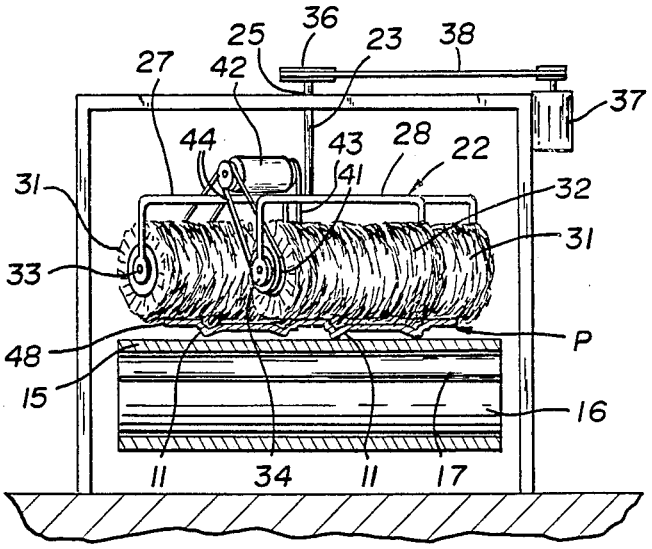
FIG. 3 is an end elevational, sectional view taken generally along the line 3—3 of FIG. 2.

By way of disclosing a preferred embodiment of the invention, and not by way of limitation, there is shown in FIGS. 1, 2, and 3 an appartus according to the invention being used to buff a surface of a molded hardboard doorskin panel P. Such panels, examples of which are manufactured and sold by the Masonite Corporation under the trademark "Colonist", are typically more than six feet in length and more than two feet in width. The panel has three pairs of rectangular recessed areas 10, 11, and 12, which simulate the appearance of architectural millwork. The entire upper surface of the panel is molded in relief with a wood grain textured pattern. Prior to entering the apparatus, the upper surface of the panel P is coated with a glaze stain.

The panel P is conveyed through the buffing apparatus by endless conveyor belt 15 driven by powered rollers 16. Intermediate support of the belt 15 and panel P is provided by rollers 17. The panel is fed or loaded on the belt 15 at the end 18 and moves linearly and longitudinally as indicated by arrow 19 toward end 20 where it is unloaded or passed on to subsequent steps in the manufacturing process.

At approximately the midpoint of the conveyor arrangement, a rigid frame 21 straddles and passes over the conveyor. At approximately the midpoint of the frame 21, a carriage 22 is supported between and below the frame 21 and above the conveyor belt 15. The carriage includes a central, generally vertical member 23 which is journalled to the frame 21 about a rotational axis 24 at bearing 25. The carriage further includes a central yoke 27 extending generally horizontally outwardly from the vertical member 23 and two outer yokes 28 generally parallel to central yoke 27 and spaced apart on either side thereof. The outer yokes 28 are joined to the central yoke 27 by a pair of cross members 29.

The carriage 22 carries two coaxial buffing rolls 31 which are supported below and parallel to central yoke 27. At their outer ends, the rolls 31 are journalled on a common shaft at outer bearings 33. The carriage also carries two outer buffing rolls 32, each supported below and parallel to an outer yoke 28 and journalled on bearings 34.

The buffing rolls 31, 32 are comprises of layers of cloth discs or sheets. Other materials such as bristles or strings may be chosen as appropriate for the flexibility, compliancy, or absorbency needed to achieve the desired surface finish.

A pulley 36 is provided fixed to the top of carriage vertical member 23. An electric motor 37 is fixed to frame 37 with belt 38 transmitting power from motor 37 to pulley 36. In operation, motor 37 provides power to rotate the entire carriage 22 and the buffing rolls 31, 32 carried thereon about axis 24 as indicated by arrow 39.

A pulley 40 is fixed to the common shaft of the central buffing rolls 31 between the two central rolls. Two additional pulleys 41 are fixed to the ends of outer buffing rolls 32. A motor 42 is mounted on central yoke 27 of the carriage 22 and connected by belt 43 to pulley 40 and by belts 44 to pulleys 41. In operation, motor 42 provides power to spin all the buffing rolls about their spin axes such as axis 46 of rolls 31 and as indicated by arrow 47.

Thus, with the entire apparatus in operation, carriage 22 and the buffing rolls 31 and 32 are rotating about the axis 24 while each buffing roll 31 and 32 is spinning about its spin axis 47. Simultaneously, the workpiece P is linearly advancing while its upper surface is being held in buffing contact with the rolls.

It is necessary to select or adjust the angular velocities of the rolls about axis 24 and their spin axes, and the speed at which the workpiece advances with respect to the rollers such that the desired finish is obtained. The more irregular or detailed the workpiece surface, then the more revolutions of the rolls about axis 24 may be needed. This may be accomplished by slowing the travel of the workpiece, by speeding the rotation of the carriage 22 about axis 24, or both. The combined linear and rotational motions of the workpiece and buffing rolls ensure that the recesses, protrusions, and irregularities of the workpiece surface will be buffed in all directions and orientations.

To obtain complete coverage of the workpiece surface, it is desirable that the combined width between the outer ends of central buffing rolls 31 and the distance between outer buffing rolls 32 be at least slightly greater than the width of the workpiece P. This will also allow for the buffing rolls to wipe the workpiece edges 48.

Figure 4:
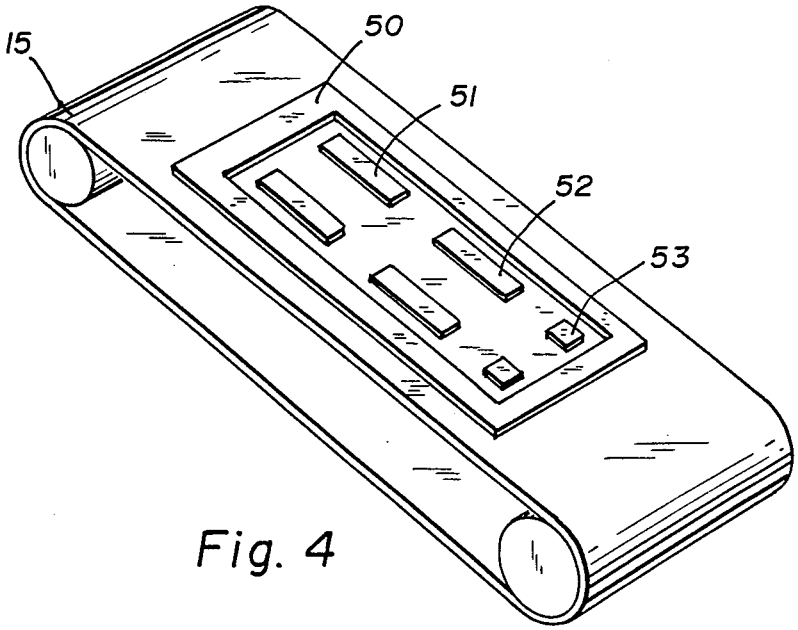
FIG. 4 is a perspective view of an alternate construction of the workpiece conveyor of the apparatus of the invention.

Depending on the shape and strengh of the workpiece, and the amount of buffing force applied, it may be necessary to provide a means for supporting and stabilizing the workpiece on the conveyor belt 15. As shown in FIG. 4, this may be accomplished by providing raised areas 50, 51, 52, and 53 which define a support region on the surface of the belt which conform generally to the shape of the underside of the workpiece. These raised areas are adapted to mate with the recesses of the underside of the workpiece and to resist any flexing of the workpiece caused by the pressure of the buffings rolls. One or more sets of such support regions may be provided along the length of the belt. It may also be necessary to provide means for registration of the workpieces with the support regions.

While the invention has been disclosed with reference to a specific preferred embodiment, other variations and modifications may be apparent to those skilled in the art without departing from the scope of the claims which follow.

What is claimed is:

1. Apparatus for buffing a surface of an article of lateral and longitudinal extent, said surface lying generally in a plane but having irregularities disposed outside said plane, comprising:

at least one buffing roll supported in a position with the spin axis of said buffing roll lying in a plane generally parallel to said plane of said surface and spaced apart from said surface, said buffing roll rotatable about a second axis generally perpendicular to said plane of said surface;

first drive means for spinning said roll about said spin axis;

second drive means for rotating said roll about said second axis; and means for longitudinally advancing said article relative to said roll and for supporting said surface in wiping contact with said roll.

2. Apparatus for buffing a surface of an article of lateral and longitudinal extent, said surface generally lying in a plane but having irregularities disposed outside said plane, comprising:

a plurality of buffing rolls having the spin axes of said buffing rolls lying in a plane generally parallel to said plane of said surface and spaced apart from said surface;

carriage means for carrying said rolls spaced apart from each other and generally parallel to each other, said rolls spinnable about the cylinder axes of said rolls within said carriage means, and said carriage means rotatable about a second axis generally perpendicular to the plane of said surface, first drive means for spinning said rolls about said spin axes;

second drive means for rotating said carriage means about said second axis; and means for longitudinally advancing said article relative to said carriage and for supporting said surface in wiping contact with said rolls.

3. A method for buffing a surface of an article of lateral and longitudinal extent, said surface generally lying in a plane but having irregularities disposed outside said plane, comprising the steps of:

supporting at least one buffing roll with the spin axis of said roll lying in a plane generally parallel to said plane of said surface and spaced apart from surface;

spinning said roll about the spin axis of said roll;

rotating said roll about a second axis disposed generally perpendicular to said surface; and longitudinally advancing said article relative to said roll while holding said surface in wiping contact with said rolls.

4. The method of claim 3 wherein said step of supporting comprises supporting a plurality of buffing rolls in a carriage means with the spin axes of said rolls spaced apart from each other and generally parallel to each other.

* * * * *